US008353790B1

(12) United States Patent
Kilfeather

(10) Patent No.: US 8,353,790 B1
(45) Date of Patent: Jan. 15, 2013

(54) GOLF BALL AND GOLF TEE PLACEMENT AND RETRIEVAL DEVICE

(76) Inventor: Thomas Kilfeather, West Babylon, NY (US)

( * ) Notice: Subject to any disclaimer, the term of this patent is extended or adjusted under 35 U.S.C. 154(b) by 0 days.

(21) Appl. No.: 13/595,516

(22) Filed: Aug. 27, 2012

(51) Int. Cl.
*A63B 57/00* (2006.01)

(52) U.S. Cl. ..... 473/386

(58) Field of Classification Search ..... 473/132, 473/386; 294/19.2
See application file for complete search history.

(56) References Cited

U.S. PATENT DOCUMENTS

| | | | | | |
|---|---|---|---|---|---|
| 4,313,604 | A * | 2/1982 | Baxter | 473/132 |
| 4,526,369 | A * | 7/1985 | Phelps | 473/133 |
| 4,951,947 | A * | 8/1990 | Kopfle | 473/133 |
| 4,968,079 | A | 11/1990 | Burton | |
| 5,037,235 | A | 8/1991 | Aquilina | |
| 5,310,177 | A | 5/1994 | Conrad et al. | |
| 5,439,213 | A * | 8/1995 | Pimentel | 473/386 |
| 5,494,279 | A * | 2/1996 | Ahner | 473/386 |
| 5,499,813 | A * | 3/1996 | Black | 473/386 |
| 5,624,333 | A * | 4/1997 | Dayton | 473/386 |
| 5,759,117 | A * | 6/1998 | Erickson, Jr. | 473/386 |
| 5,772,533 | A * | 6/1998 | Dahlmann | 473/386 |
| 5,839,972 | A | 11/1998 | Swanson | |
| 5,857,927 | A | 1/1999 | Driscoll et al. | |
| 6,053,821 | A * | 4/2000 | Palmer | 473/386 |
| 6,254,497 | B1 | 7/2001 | Brant et al. | |
| 6,461,254 | B1 * | 10/2002 | Ballett et al. | 473/386 |
| 6,817,955 | B2 | 11/2004 | O'Donnell et al. | |
| 6,843,737 | B1 * | 1/2005 | Smith et al. | 473/386 |
| 7,390,268 | B2 | 6/2008 | Merriman | |
| 2005/0170904 | A1 | 8/2005 | Smeeth | |

* cited by examiner

*Primary Examiner* — Steven Wong
(74) *Attorney, Agent, or Firm* — David F. Jacobs; Smith & Hopen, P.A.

(57) ABSTRACT

A golf ball and golf tee retrieval device for eliminating the need to squat or bend. A shaft has two ends: One for ball retrieval and the other for ball and tee setting. The ball retrieval end includes a cup that is sized and adapted to retrieve or pick-up a ball. The setting end includes a housing unit, a wing portion and a boss connector. The boss connector engages the shaft. The housing unit includes six walls adapted to substantially house a golf ball and golf tee. The wing portion is adapted to provide a pivot point to assist in tee placement and easy disengagement from the golf tee and the golf ball.

6 Claims, 5 Drawing Sheets

GOLF BALL AND GOLF TEE PLACEMENT AND RETRIEVAL DEVICE

BACKGROUND OF THE INVENTION

1. Field of the Invention

This invention relates to devices used to aid golfers. More specifically, it relates to a device for aiding golfers in setting a golf ball and golf tee into turf, without requiring the user to squat or bend to the ground.

2. Brief Description of the Related Art

Playing a hole on a golf course is initiated by placing a tee on the ground along with a golf ball. Placement of the tee requires a golfer to bend over and place the tee into the ground. A ball is then balanced on top of the tee. This constant placing down and picking up of the golf ball anf golf tee can present a major strain on a golfer, especially for those that may have some sort of physical limitation or handicap that prevents such movement. There have been many devices that attempt to eliminate the stresses associated with squatting and bending over to place or pick up a tee or golf ball.

Several prior art devices focus solely on the placement of either a golf ball or golf tee. Examples of these are shown in U.S. patent application Ser. No. 10/770,907 to Smeeth and U.S. Pat. No. 5,857,927 to Driscoll et al. A major problem with these devices is that they only solve half of the problem. A golfer using one of these devices must still bend down to set a tee or golf ball depending on which function the device performs. For example, a golfer using the tee setting device of U.S. Pat. No. 5,857,927 must still bend down for placement of the golf ball. In contrast, someone utilizing the device disclosed in U.S. patent application Ser. No. 10/770,907 would still have to bend down for placement of the tee. Thus, the retrieval and placement devices are ineffective as a comprehensive device for preventing excessive and undesired squatting and bending.

There have been many attempts to provide an "all-in-one" device that can both pick up and place a golf ball and golf tee. Examples of such devices are described in U.S. Pat. Nos. 6,254,497 to Brant et al.; 5,839,972 to Swanson; 5,310,177 to Conrad et al.; 6,817,955 to O'Donnell et al.; 7,390,268 to Merriman, Each of these devices discloses a unique attempt to solve the need for bending or squatting, but each has several problems that have yet to be overcome.

The Brant and Swanson inventions include a clamping mechanism for gripping the golf ball and golf tee. A problem associated with use of these devices is the inability to measure the depth of a golf tee being placed into the ground. The devices also rely on the activation and deactivation of a clamping device. Such mechanical mechanisms may become faulty over time resulting in the device not functioning properly and inconsistent results. In addition, the devices require user input to engage and disengage the clamping device which may be difficult or cumbersome for some users.

Other devices like those disclosed by O'Donnell and Conrad rely on a flat surface that uses a scooping mechanism for retrieval and placement of the golf ball and golf tee. An advantage with this type of mechanism is the ease with which a golf ball can be picked up and placed; however, there are several disadvantages associated with use of a scooping mechanism for ball placement. Golf ball placement can often be inaccurate as the ball rolls off the device. Inaccuracy may be further increased when attempting to place the golf ball on the head of the golf tee. These devices also lack a way of measuring and adjusting the depth of golf tee placement. Additionally, these devices rely on releasably engageable mechanisms for proper golf ball placement.

Accordingly, there exists a need for a device that can be used for golf ball and golf tee retrieval and placement that is light, easy to use, and eliminates the need for squatting or bending. Additionally, there exists a need for a device that can achieve golf ball and golf tee placement and retrieval while providing an adjustable reference point to measure the depth of golf tee placement.

However, in view of the art considered as a whole at the time the present invention was made, it was not obvious to those of ordinary skill in the field of this invention how the shortcomings of the prior art could be overcome.

BRIEF SUMMARY OF THE INVENTION

The long-standing but heretofore unfulfilled need for an apparatus for reducing the neew for squatting an bending while setting and retrieving a golf ball and golf tee is now met by a new, useful, and nonobvious invention.

The novel structure includes a shaft with two ends; a holding end and a setting end. Holding end can contain a means of ball retrieval mean such as that already known in the art. Setting end comprising a housing unit and a winged portion.

Housing unit has an upper wall and a lower wall perpendicular to the longitudinal extent of the shaft. Upper and lower walls are separated such that a golf ball and cup portion of a golf tee can substantially fit between the two walls. Lower wall contains a half, frusto-conical structure adapted to fit a pre-determined sized tee. Four walls are orientated around the four sides of the upper and lower walls. The four walls are; a support wall, a back wall, an open wall and a front wall. Each of the four walls are orientated such that a golf ball and cup portion of a golf tee can substantially fit within. Open wall is an open area wherein a ball and tee may enter and exit the housing portion.

The wing portion includes a base portion extending from lower wall of the housing unit. Wing portion includes a fin located above the planar surface of the base portion. Fin portion curves such that the top portion of the fin abuts a wall. The wing portion also includes an underlying pivot point below the planar surface of the base portion. Underlying pivot point is adapted to engage an overlying pivot point such that the pivot points may stack upon one another. Preferably, the pivot points are hemispherical in shape.

In accordance with a further aspect of the present invention, a method of setting a golf ball and a golf tee without squatting or bending to the ground is provided. The method includes use of a device for setting a golf ball and golf tee having a shaft with a ball retrieval end and a setting end having a housing unit for a golf ball and an upper portion of a golf tee; said housing unit having a half frusto-conical structure on a bottom wall of said housing unit wherein said half frusto-conical structure conforms to a pre-determined size tee, said setting end further including a wing structure with an underlying pivot point adapted to engage an overlying pivot.

A golf tee is placed within the half, frusto-conical structure located in the housing unit of the setting mechanism that is sized to fit the selected golf tee. Tee is placed such that a portion of the cup portion of the tee rests flush or above the lower wall of the housing unit. Golf ball is then inserted through the open wall into the housing portion so that it substantially rests upon the cup portion of the tee. Once the golf ball and golf tee are set within the housing unit, the setting end is orientated towards the ground. Golf tee is then inserted into the ground through pushing the setting end towards the ground. The golf tee continues to sink into the ground until a pivot point on the setting mechanism comes into contact with the ground. After the golf tee has reached desired depth the shaft and setting mechanism are rotated such that the set golf ball and golf tee pass through the open wall. Setting mechanism is then lifted vertically away from the set golf ball and golf tee. The setting mechanism may also be used to retrieve a previously set tee by inserting the tee into the half, frusto-conical structure and lifting vertically away from the ground.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a", "an", and "the" include plural referents unless the content clearly dictates otherwise. As used in this specification and the appended claims, the term "or" is generally employed in its sense including "and/or" unless the context clearly dictates otherwise.

Figure 1:
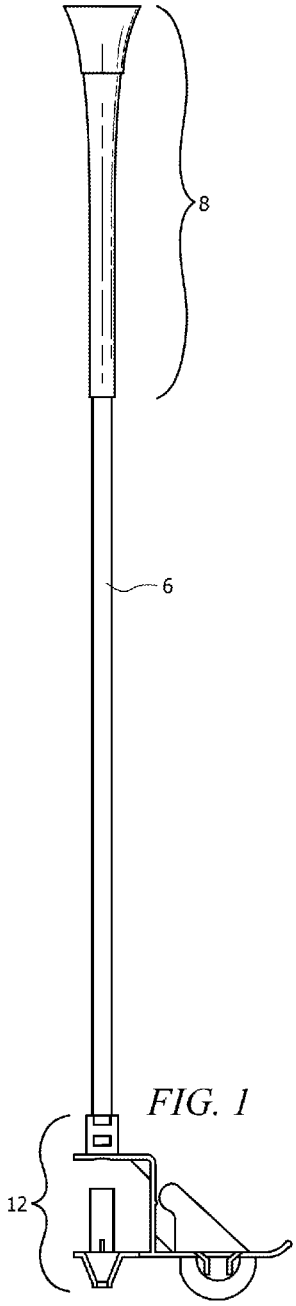
FIG. 1 is a full view illustration of a preferred embodiment of the present invention.
Figure 2:
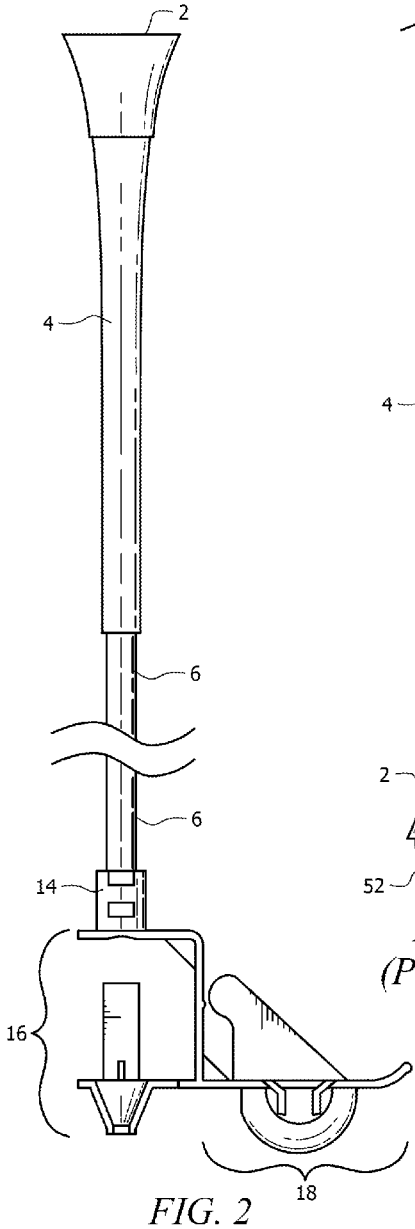
FIG. 2 is a full view illustration of a preferred embodiment of the present invention.

The novel structure is denoted as a whole in FIG. 1 by the reference numeral 10. The device includes a shaft 6 having two ends, i.e., a first end for ball placement and tee placement and retrieval 12 and a second end for ball retrieval 8.

Shaft 6 has a sufficient length so that a user can easily manage the ball 52 and tee 54 without unnecessarily squatting or bending. Thus, the shaft may be varying lengths to accommodate varying heights of individuals. It is possible for the shaft to be pre-made to a user's specific height, height range or it may be adjustable. An adjustable shaft 6 used could be similar to that of U.S. Pat. No. 5,037,235 to Aquilina. Having an adjustable shaft 6 would allow the user to increase or decrease the length to fit the specific needs of the user, allowing the user to select the amount of bending and squatting necessary in a particular situation.

Shaft 6 may be made of any suitable material known for providing a substantially rigid structure. Preferred materials include wood, steel, graphite, plastic, carbon fiber or any materials typically used in the production of golf shafts. Grip 4 may be placed towards ball retrieving end 8 of the device to assist in comfort and control. Grip 4 may be made of materials traditionally used to assist in grip, but preferably rubber.

Figure 3:
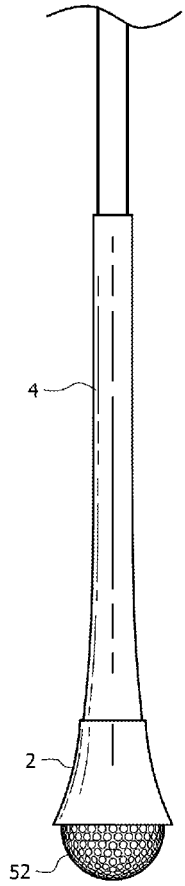
FIG. 3 (Prior Art)
FIG. 3 is an illustration of the prior art.

Similar to the construction of the ball handling end in U.S. Pat. No. 6,254,497, ball retrieval end 8 includes cup 2 that is sized and adapted to retrieve or pick-up ball 52, as shown in FIG. 3. Cup 2 is preferably formed of rubber, but may be formed of other suitable materials that can be adapted to retrieve ball 52. Retention of the ball may be achieved through a snap fit, suction, friction, or any other suitable means as is known in the art. Cup 2 may be permanently fixed to ball retrieval end 8 or it may be removably fixed. In an alternative embodiment, ball retriever end 8 may be substantially similar to the device disclosed in U.S. Pat. No. 4,968,079 or any other device known in the art for ball retrieval that can attach to the end of a golf shaft.

Figure 4:
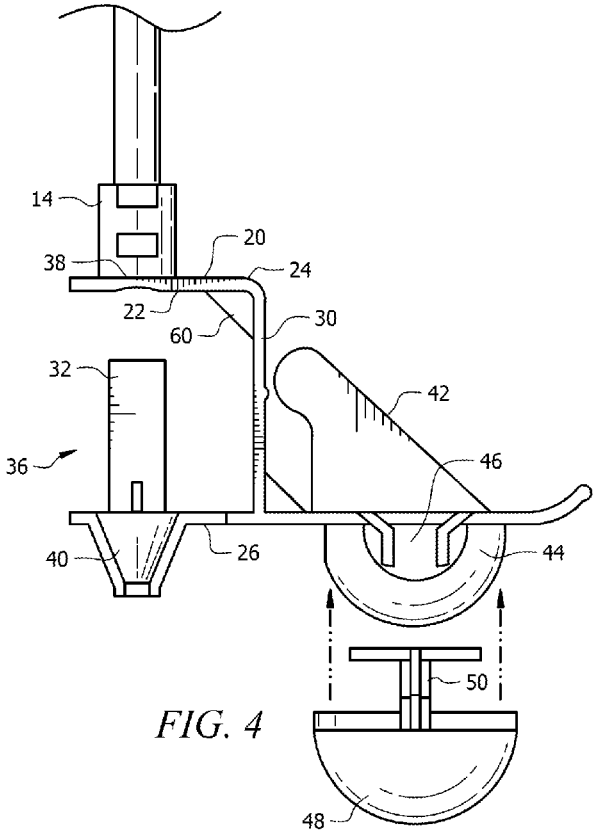
FIG. 4 is a side view of the setting mechanism showing an optional overlying pivot point.
Figure 5:
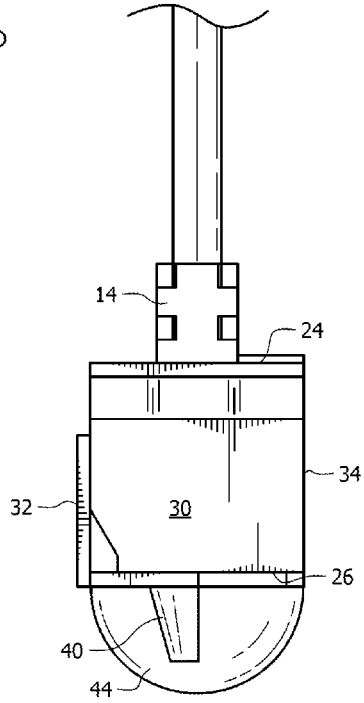
FIG. 5 is a front view of the setting mechanism.

The difference between the prior art and the present invention resides in the first end used for ball 52 placement and tee 54 placement and retrieval indicated generally at 12, hereinafter referred to as the "setting mechanism." FIGS. 4 and 5 illustrate the setting mechanism from a side view and front view respectively. The setting mechanism 12 includes boss connector 14, housing unit 16, and winged portion 18. Boss connector 14 is adapted to engage shaft 6 along its longitudinal extent. Boss connector 14 is formed as a part of the housing unit. Specifically, boss connector 14 is formed a part of upper housing wall 20. In an alternative embodiment, upper wall 20 is permanently fixed to shaft 6.

Setting mechanism 12 further includes housing unit 16 adapted to house ball 52 and tee 54. Housing unit 16 includes upper wall 24 perpendicular to the longitudinal extent of the shaft and lower wall 26 running parallel to upper wall 24. Upper and lower walls 24 and 26 are separated so that ball 52 and top of tee 54 can substantially fit between the two walls. Housing unit 16 further comprises four walls oriented around upper and lower walls 24 and 26 to substantially form a cavity adapted to hold ball 52 and tee 54. Four walls formed around upper and lower walls 24 and 26 are herein referred to as back wall 30, support wall 32, open wall 34, and front wall 36. Together the six walls substantially form a housing unit 16 for the ball and top portion of the tee. Walls are adapted so that when the ball rests within housing unit 16, the center of ball 52 is substantially in line with the longitudinal extent of shaft 6. Housing unit 16 may be of various materials but preferably a hard material with some flexibility, such as plastic.

Upper wall 24 includes outer facing portion 20, hereinafter the "outer" and an inner facing portion 22, hereinafter the "inner". Outer 20 faces ball retrieval end 8 of shaft 6. Boss connector 14 froms from outer 20. Inner 22 is the portion facing opposite outer 20. Inner 22 comes into contact with the surface of ball 52 when it is placed within housing unit 16. Groove 38 may be cut within inner 22 to form to the curvature of the body of ball 52. Preferably, groove 38 is orientated such that it forms a path from where shaft 6 contacts upper 20 to open wall 34. This creates a groove path for ball 52 to follow as it is slides in and out of housing unit 16.

Lower wall 26 is formed of a base with diagonal cuts originating from the direction of open wall 34 and leading into substantially half frusto-conical structure 40. The base, or wider portion of frusto-conical structure 40 faces ball retrieval end 8. The narrow end of frusto-conical strucuture 40 faces away from ball retrieval end 8. Preferably, frusto-conical structure 40 is oriented substantially along the longitudinal extent of shaft 6 so that it is in line with where the shaft 6 engages boss connector 14 and the center of ball 52 when it is placed within housing unit 16. Frusto-conical structure 40, hereinafter the "tee holder," is adapted to form to a predetermined sized tee 42, such that tee 42 rests within tee holder 40 so that open face portion 44 of the tee on which ball 52 rests faces ball retrieving end 8. Preferably, longitudinal axis of symmetry of tee 42 is coincident with the longitudinal axis of symmetry of shaft 6.

A preferred embodiment uses a "Martini Golf Tee." Martini golf tees are 3¼ inches tall and made of a proprietary polymer resin. They have a large open face region which has a shape similar to that of a martini glass. The larger open face region allows for more surface upon which ball 52 may rest within the housing unit.

Back wall 30 partially serves to separate housing unit 16 from winged portion 18 of setting mechanism 12. It extends substantially the entire height and width of the housing unit. Some embodiments have wing portion 18 formed as a continuous part of bottom wall 26, while in other embodiments they are two separate pieces. In either embodiment, back wall 30 is a wall enclosing housing unit 16. Preferably, back wall 30 is opposite front wall 36 although other embodiments may place support wall 32 or open wall 34 opposite back wall 30. In another preferred embodiment, groove 38 may be cut within the back wall that forms to the curvature of the body of ball 52. Additionally, wedge 60 may be placed between upper wall 24 and back wall 30 to help form golf ball housing unit 16.

Support wall 32 is a wall that is used to substantially enclose housing unit 16. It may be a fully enclosed wall extending the full height and length of housing unit 16. In another embodiment, support wall 32 is any length or height that serves to substantially block or prevent ball 52 from easily rolling in and out through support wall 32 area.

Open wall 34 is a side of housing unit 16 that is substantially void of any wall or object that would serve to block ball 52 entry or exit. Ball 52 enters and exists housing unit 16 through open wall 34. In another embodiment, open wall 34 may include a wall that can be opened or closed through conventional means to allow selective ball 52 entry and removal from housing unit 16. In a preferred embodiment, open wall 34 faces the same direction as the open side of tee holder 40. This allows ball 52 and tee 54 to exit through the open wall substantially simultaneously. It is also preferable that open wall 34 be opposite support wall 32 or back wall 30.

Front wall 36 is generally the area opposite back wall 30 although it is foreseeable that it be placed opposite another wall. In a preferred embodiment, front wall 36 is an area left open, such that ball 52 may enter and exit housing unit 16 through front wall 36. Alternatively, front wall 36 may have varying lengths and heights to serve as another enclosure for housing unit 16. For example, front wall 36 may have a structure that extends vertically and horizontally halfway across housing unit 16 leaving the rest of front wall 36 open.

Winged portion 18 of setting mechanism 12 extends from bottom wall 26 of housing unit 16 in one direction away from housing unit 16. The part extending from bottom wall 26 of housing unit 16 substantially forms the base of winged portion 18. Support fin 42 extends from the base of winged portion 18 substantially in the direction of ball retrieving side 8. Fin 42 curves in the direction of housing unit 16, such that the tip of fin 42 touches or is substantially close to touching a wall of housing unit 16. Pivot point 44 is oriented below the base of winged portion. Preferably, pivot point 44 is a hemisphere with four planar ends. The planar surfaces are perpendicularly contiguous to the base of wing portion 18 and extend vertically in underlying relation to said base. Four planar surfaces 46 relate in perpendicular fashion to one another along their vertical extents, as each two planar surfaces face each other. Two opposing planar surfaces 46 abut the lateral edges of the base of wing portion 18 with grooves adapted to receive an overlying pivot point 48, such that an overlying pivot point 48 can be disposed around said two opposing planar surfaces 46 and said lateral edges of the base of wing portion 18.

Overlying pivot point 48 includes two opposing planar surfaces with extending arm 50 portions adapted to engage said lateral edges 46 of the base of wing portion 18. Several pivot point overlays may be adapted to engage each other in a stacking fashion. Arms 50 of overlying pivot point 48 are made of flexible material adapted to stretch and immediately return to its pre-stretched position. Preferably, the material is made from a strong, flexible plastic that makes an audible "snap" when arms 50 of the overlaying pivot point 48 engage the grooves of underlying pivot point 44. Alternative embodiments may use various conventional means of attaching overlying pivot points 48 with underlying pivot points 44, such that they stack on each other and may be selectively removed.

Figure 6:
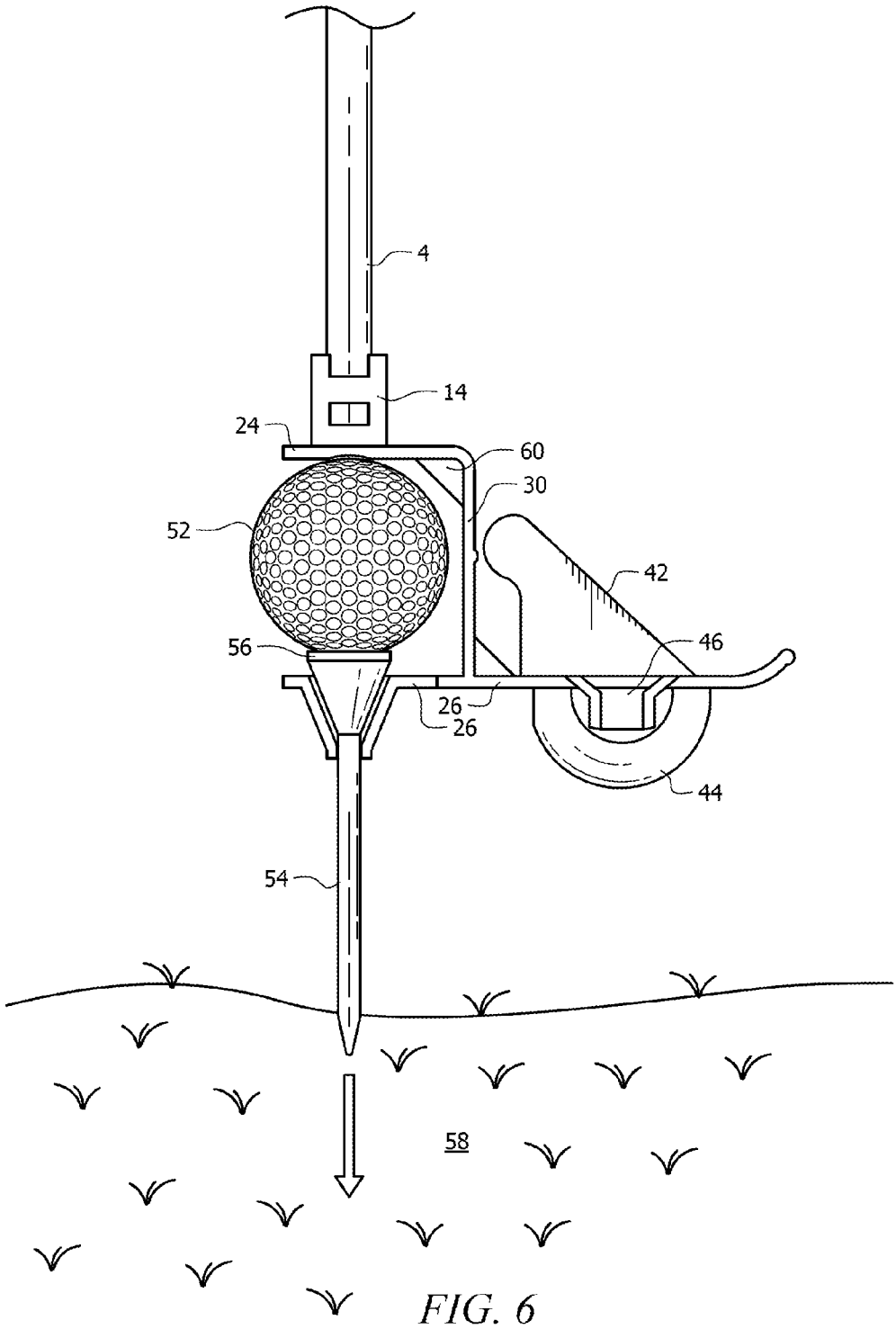
FIG. 6 is an illustration of the setting mechanism pressing a ball and tee into the ground.

FIG. 6 depicts setting mechanism 12 with tee 54 and ball 52 placed inside housing unit 16. Tee 54 is placed substantially through open wall 34 in housing unit 16 and into pre-formed tee holder 40. Tee 54 rests in tee holder 40 such that the face of tee 56 rests above or flush with bottom wall 26 of housing unit 16. Preferably, ball 52 is inserted after tee 54 placement so that ball 52 rests substantially on the face of the tee. Ball 52 is inserted into into the housing unit and rests upon the face of tee 56.

FIG. 6 also illustrates how setting mechanism 12 is used to set tee 54 and ball 52 into any ground 58 or turf. Tee 54 and ball 52 are substantially contained within housing unit 16, with tee 54 resting in tee holder 40 and ball 52 resting substantially on the face of tee 56. The invention as a whole is positioned such that ball retrival end 8 substantially faces opposite ground 58 and setting mechanism 12 is substantially oriented towards ground 58. The point of tee 54 should be pointing where the user wishes to set ball 52 and tee 54. The user then applies downward pressure on shaft 6 which presses tee 54 into ground 58. Tee 54 may continue to dig into ground 58 until pivot point 48 on wing portion 18 comes into contact with ground 58. When pivot point 40 comes into contact with ground 58, wing portion 18 flexes upwards and fin 42 is pressed into a wall of housing unit 16. Alternatively, wing portion 18 may be made of non-flexable material preventing any bend. Each overlying 48 and underlying 44 pivot point is representative of a pre-determined height, such that overlying pivot points 44 may be added or removed to increase or decrease depth of tee 54 in ground 58. For example, wing portion 18 with one overlying 48 pivot point corresponds to a pre-determined depth while wing portion 18 with no overlying 48 pivot pont will correspond to a deeper tee 54 depth.

Figure 7:
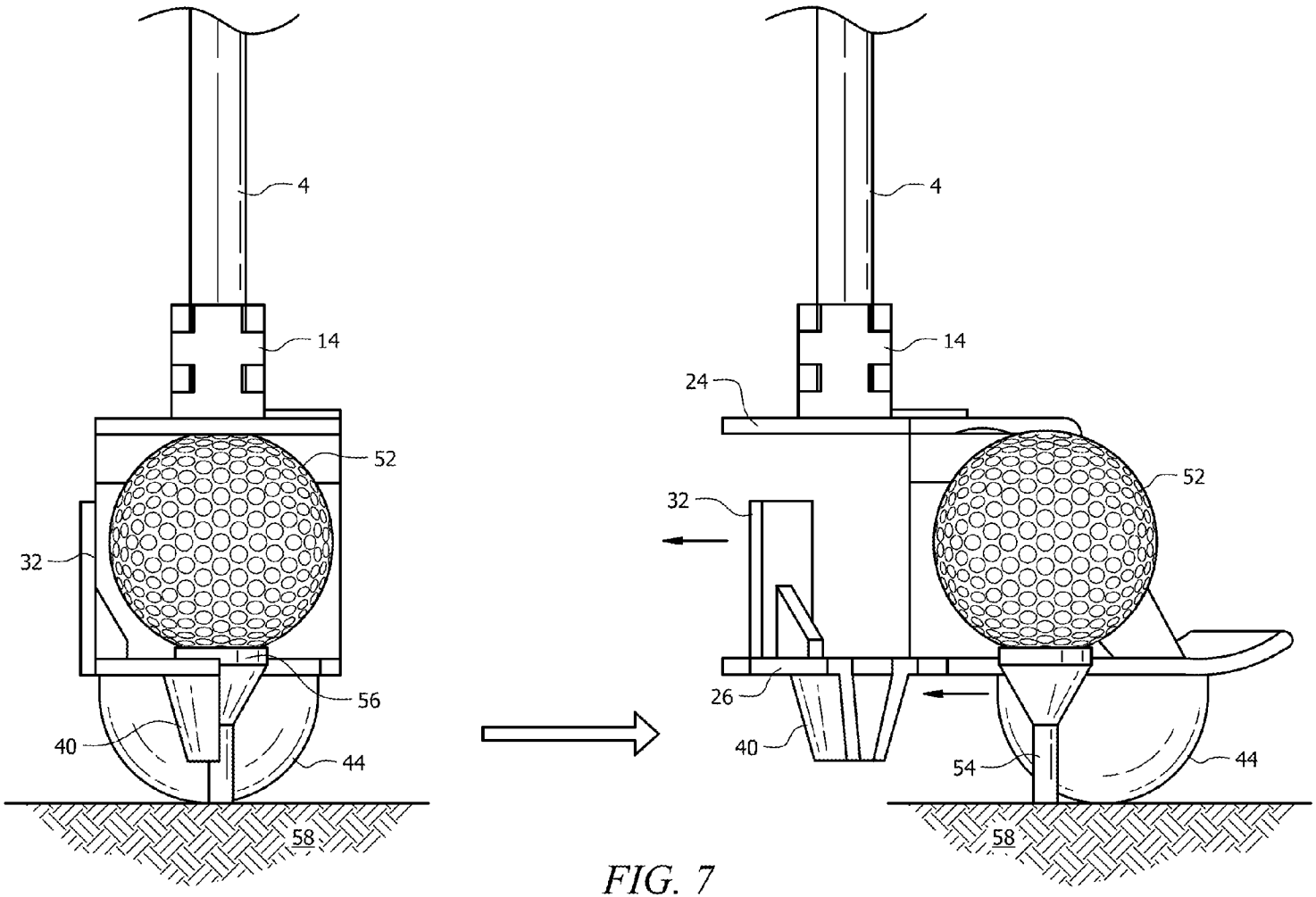
FIG. 7 is an illustration of disengagement of the setting mechanism from a set tee and ball.
Figure 8:
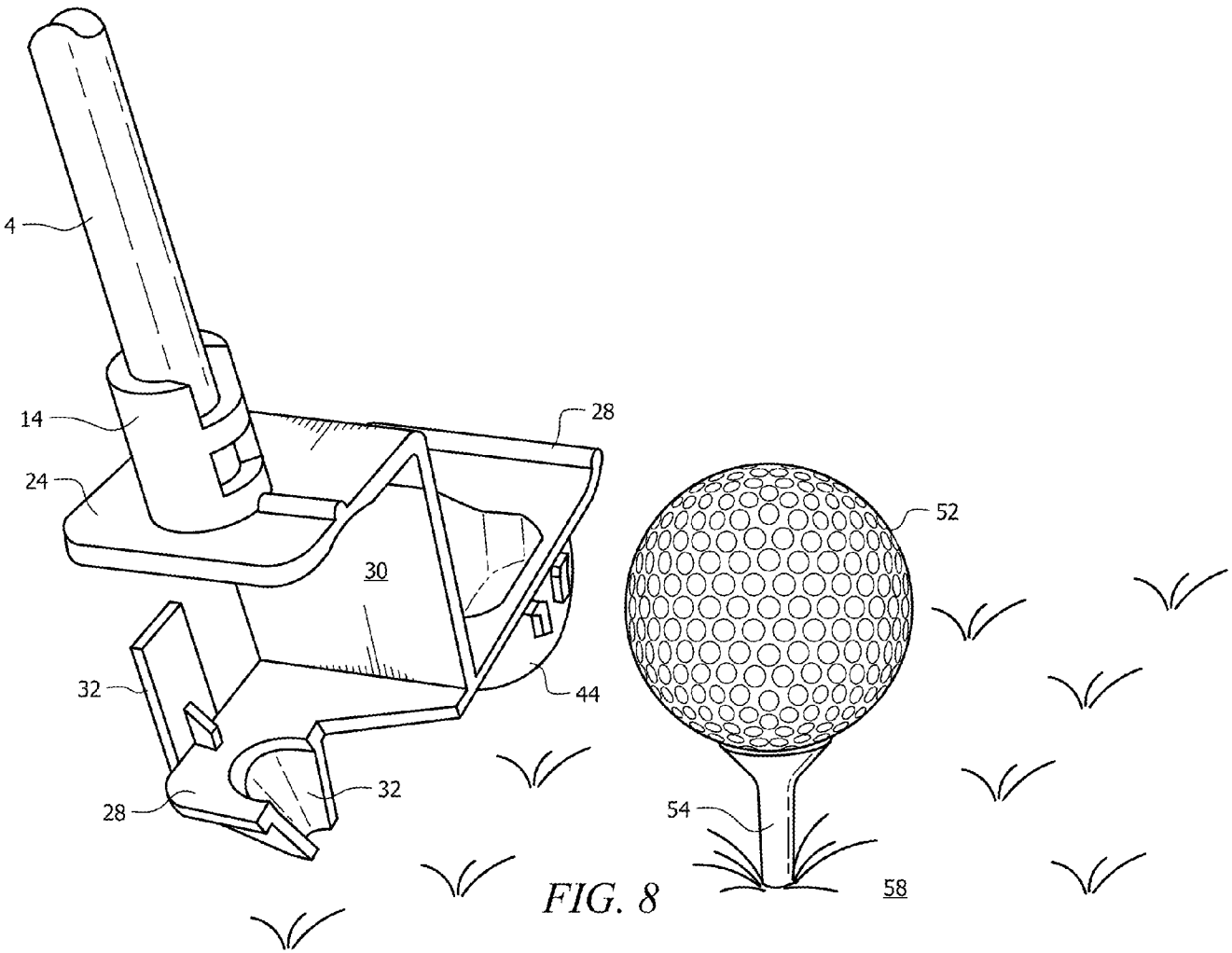
FIG. 8 is an illustration of the setting mechanism removed from a placed tee and ball.

FIG. 7 illustrates disengagement of setting mechanism 12 from tee 54 and ball 52. Shaft 6 is rotated either clockwise or counterclockwise around pivot point 44 such that ball 52 and tee 54 pass through open wall 34 of setting mechanism 12. Once setting mechanism 12 is clear, ball 52 and tee 54 are ready to be used.

Setting mechanism 12 is also used for tee 54 retrieval. Tee holder 40 is brought into contact with set tee 54. Once tee 54 is substantially in contact with tee holder 40, setting mechanism 12 is lifted upwards. Tee 54 will be pulled up along with setting mechanism 12.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF CLAIM TERMS

Cup Portion of a Tee: The hemispherical structure portion of a tee on which a ball rests.

Fin: A curved triangle-like structure commonly seen in nature on limbs of fish.

Frustrum: A cone whose tip has been removed by a plane parallel to its base.

Frusto-conical structure: refers to an object having the shape of a frustrum of a cone.

Grip: a substance used to improve holding, grasping or clamping ability on a structure.

Golf Ball: A ball specifically designed to be used in the game of golf. Many current golf balls include dimples to improve flight of the ball.

Golf Tee: At stand used to support a stationary ball. Specifically, used for supporting a golf ball.

Pivot Point: A point at which an object can pivot. Generally, the center point of any rotational system.

Shaft: is the long tapered tube which connects the golfer's hands to the club head.

Wall: Is a vertical space formed from a base extending vertically. May be a solid area but may also be an open area.

What is claimed is:

1. An apparatus for golf ball and golf tee retrieval and setting, comprising:

a shaft having a setting end and a holding end;

said setting end including a housing portion and a wing portion;

said housing portion including an upper wall and a bottom wall;

said upper wall and said lower wall being separated such that a ball and a cup portion of a tee can substantially fit between said upper wall and said lower wall;

said housing portion further including a support wall, a back wall, an open wall and a front wall such that said support wall, back wall, open wall and front wall with said upper wall and said lower wall form an area where a ball and a cup portion of a tee can substantially fit within;

said lower wall further including a base with a half, frusto-conical structure formed to fit a predetermined size tee;

said open wall further including an open area wherein a ball and tee may enter and exit said housing portion;

said wing portion including a base portion extending from said housing portion;

said wing portion further including an underlying pivot point below said base portion adapted to engage an overlying pivot point;

said wing portion further including a fin;

said fin curving so that the top portion of said fin abuts a wall.

2. A holding end as in claim 1, further comprising:

a means to pick up a golf ball.

3. An upper wall as in claim 1, further comprising:

an inner and an outer portion;

said outer portion containing a boss connector adapted to engage a golf shaft;

said inner portion containing a groove to fit the outside curvature of a golf ball.

4. A pivot point as in claim 1, wherein said pivot point is a hemisphere structure with a receptor means of engaging overlying hemispherie pivot points.

5. A method of setting a golf ball and a golf tee into the ground without squatting or bending, comprising the steps of:

providing a device for setting and retrieving a golf ball and golf tee on a ground surface having a shaft with a ball retrieval end and a setting end having a housing unit for a golf ball and an upper portion of a golf tee; said housing unit having a half frusto-conical structure on a bottom wall of said housing unit wherein said half frusto-conical structure conforms to a pre-determined size tee, said setting end further including a wing structure with an underlying pivot point adapted to engage an overlying pivot, placing a golf tee in said half frusto conical structure located within a housing unit;

pre-sizing said half frusto-conical structure to fit said golf tee;

placing a golf ball in said housing unit;

positioning said setting end towards the ground;

pushing said setting end into the ground to insert said golf tee into the ground until a pivot point on said setting end comes into contact with the ground;

rotating said setting end along said pivot point such that said golf ball and said golf tee pass through an open wall in said housing unit;

lifting said device vertically away from the golf ball and the golf tee.

6. The method of claim 4 further comprising the step of removing a golf tee from ground wherein said device comprises means for picking up a golf tee on said setting end.

* * * * *